US006164270A

United States Patent [19]

Bidner et al.

[11] Patent Number: 6,164,270

[45] Date of Patent: Dec. 26, 2000

[54] EXHAUST GAS RECIRCULATION FAULT DETECTION SYSTEM

[75] Inventors: David Karl Bidner, Livonia; Douglas Raymond Martin, Plymouth, both of Mich.

[73] Assignee: Ford Global Technologies, Inc., Dearborn, Mich.

[21] Appl. No.: 09/370,714

[22] Filed: Aug. 9, 1999

[51] Int. Cl.[7] ..... F02M 25/07

[52] U.S. Cl. ..... 123/568.16; 73/118.1; 701/108; 701/114

[58] Field of Search ..... 123/568.11, 568.16; 73/117.3, 118.1; 701/108, 114

[56] References Cited

U.S. PATENT DOCUMENTS

| | | | |
|---|---|---|---|
| 3,924,587 | 12/1975 | Murphy | 123/568.16 |
| 4,690,120 | 9/1987 | Egle | 123/568.16 |
| 5,152,273 | 10/1992 | Ohuchi | 123/568.16 |
| 5,317,909 | 6/1994 | Yamada et al. . | |
| 5,474,051 | 12/1995 | Matsumoto et al. . | |
| 5,513,616 | 5/1996 | Matsumoto et al. . | |
| 5,635,633 | 6/1997 | Kadota . | |
| 6,035,835 | 3/2000 | Shigihama et al. | 123/568.16 |
| 6,092,513 | 7/2000 | Kotwicki et al. | 123/568.16 |

*Primary Examiner*—Willis R. Wolfe
*Attorney, Agent, or Firm*—Jerome R. Drouillard

[57] ABSTRACT

An engine controller for an automotive engine having an inlet system and an exhaust system includes an EGR valve for permitting exhaust gas to flow from the exhaust system to the inlet system, and an engine controller for operating the EGR valve by closing it from its normal open position. The difference in exhaust gas pressures in an EGR line downstream of the EGR valve measured during the EGR valve normal open and closed positions is compared with first and second threshold values and the actual pressure with the EGR valve open is compared with a third threshold value to determine whether the EGR system is blocked.

8 Claims, 2 Drawing Sheets

EXHAUST GAS RECIRCULATION FAULT DETECTION SYSTEM

FIELD OF THE INVENTION

The present invention relates to an engine control system having the capability of detecting exhaust gas recirculation (EGR) system failures, particularly those due to deposit buildup or other blockage in EGR lines or passages.

DISCLOSURE INFORMATION

EGR systems have been used in automotive engines for more than a quarter century. Such systems have progressed from crude vacuum-operated systems to newer devices operated by stepper motors or linear solenoids, or other devices known to those skilled in the art. Governmental regulations require that engine controllers used in modern day automotive vehicles have the capability of entering an EGR valve diagnostic procedure on a regular basis to detect improper operation of an EGR system. Such improper operation could arise due to combustion deposits, or faults in the wiring or other support subsystems needed to operate the EGR valve. Typically, deposits accumulate on the downstream (cooler) side of the EGR line. The high molecular weight components of unburned fuel or oil in the exhaust gas which cause deposits, while usually remaining vaporized on the upstream side of the EGR valve, sometimes condense as they cool during transit through the system.

U.S. Pat. Nos. 5,317,909, 5,474,051, 5,513,616, and 5,635,633 teach an EGR valve diagnostic method to detect blockage whereby the EGR valve is alternately fully closed from its normal operating position and reopened to the normal operating position, i.e., a position that the engine controller has determined based on engine operating variables. The pressure in the system near the downstream outlet of the EGR valve is compared under the two conditions. If there is little restriction, the pressure difference between the EGR valve normal open and closed positions will be in a predetermined range and small relative to the blocked case. This known EGR valve diagnostic method works well under normal situations, where the blockage increases gradually. However, if complete blockage of the system were to occur suddenly due to such causes as catastrophic failure of the EGR line, or large flakes of deposit plugging the hole at once, or due to artificial blockage during an emissions certification test, the difference in pressure between the EGR valve normal open and closed positions would be in range, falsely indicating system integrity.

Patents '909, '051, '616, and '633 further teach how to perform a valid test, i.e., verifying that the engine conditions were sufficiently stable during the course of the EGR valve diagnostic procedure.

The present invention solves the problems with known EGR diagnostic sequences, because not only is the difference in pressure at the EGR valve between the valve normal open and closed positions evaluated to determine if the system is in between two thresholds indicating allowable blockage level, but the pressure during the EGR valve on position is also compared with a third threshold. If the pressure sensed with the EGR valve open approaches exhaust pressure, it indicates severe blockage and hence a fault in the system.

SUMMARY OF THE INVENTION

An engine controller for an automotive engine having an inlet system and exhaust system includes a plurality of sensors for measuring engine operating parameters and an EGR valve for permitting a controlled amount of exhaust gas to flow from the exhaust system to the inlet system of the engine. An engine controller operatively connected with the sensors operates the EGR valve for diagnostic purposes by closing the EGR valve for a brief period. The pressure at the downstream side of the EGR valve during the valve normal open and close periods are compared. The difference in the pressure at the valve open and close conditions should be greater than a Threshold 1 and less than a Threshold 2 to indicate an acceptable flow, i.e., minimal blockage. If, however, the difference in the pressures is large, i.e., exceeds a predetermined Threshold 2, it indicates that blockage in the downstream line is beyond acceptable limits. Analysis of the pressure difference, solely, correctly identifies only situations which become gradually impaired at typical EGR valve diagnostic procedure intervals.

An advantage of the present invention resides in the fact that, by evaluating the pressure during the EGR valve on portion of the EGR valve diagnostic procedure to determine that it does not exceed a predetermined Threshold 3, a situation in which a rapid or drastic increase in blockage is also detected.

If any of the following conditions occurs: 1) difference in pressures is less than Threshold 1; 2) difference in pressures exceeds Threshold 2; 3) or pressure during on portion exceeds Threshold 3): the EGR valve diagnostic procedure is repeated for confirmation of a failure; the test is validated by ensuring that the engine conditions are sufficiently constant during the measurement procedure; and, if the failure is reconfirmed and the test found to be valid, a flag is set in the engine controller indicating EGR system failure.

Other objects, features, and advantages of the present invention will become apparent to the reader of this specification.

DETAILED DESCRIPTION OF PREFERRED EMBODIMENTS

Figure 1:
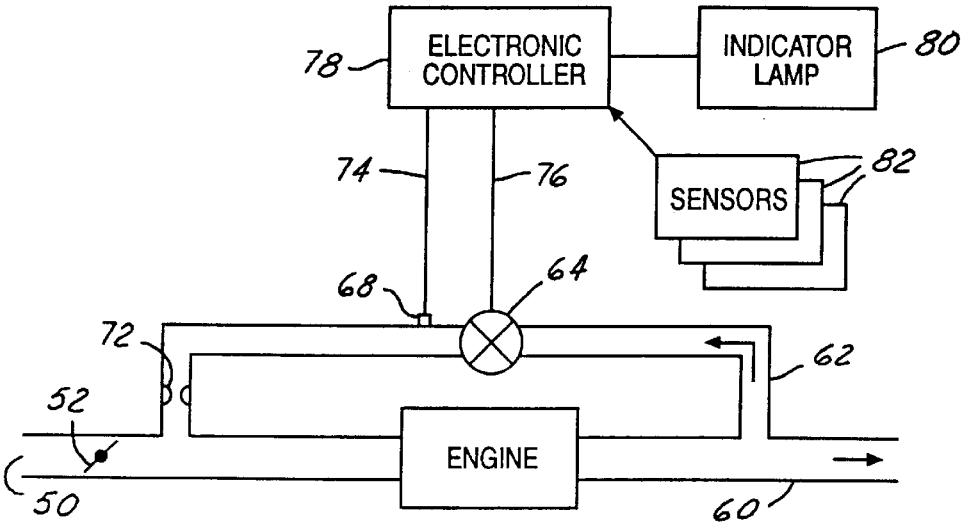
FIG. 1 is a schematic representation of an engine having a control system and sensors according to the present invention.

As shown in FIG. 1, engine 56 receives air and fuel from inlet system 50 the flow rate of air being controlled by throttle 52, with the products of combustion leaving the engine through exhaust system 60. EGR valve 64, which is operated by controller 78, controls the flow of EGR from exhaust system 60 through the upstream EGR line 62, through EGR valve 64, and then through downstream EGR line 70 and into inlet system 50. Pressure sensor 68, which is used according to the present invention for fault detection, is located in downstream line 70 of the EGR valve 64. The output of pressure sensor 68 is communicated to controller 78 via line 74.

In the downstream line 70 from the EGR valve 64, condensation of high molecular weight unburned fuel or oil components or byproducts thereof may occur and lead to blockage 72. Engine control unit 82 is connected to a fault indication lamp 80 which, in the event of fault detection, notifies the operator of a fault condition and the necessity for service. A plurality of sensors 82 measure various engine operating parameters such as engine coolant temperature, mass airflow, throttle position, spark timing, and other parameters known to those skilled in the art and suggested by this disclosure. Controller 78 is drawn from the class of engine controllers also known to those skilled in the art and suggested by this disclosure.

Figure 2:
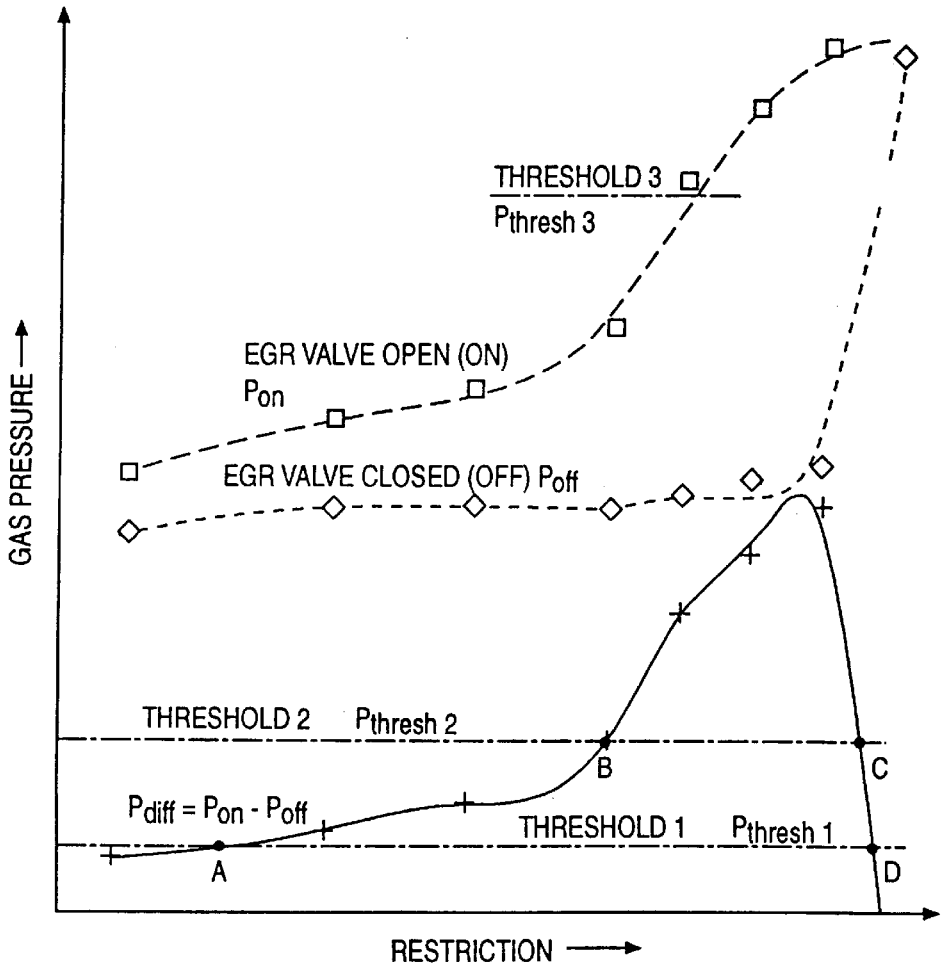
FIG. 2 is a graph of pressure at the downstream side of the EGR valve at both EGR valve normal open and closed positions and the difference as a function of blockage.

In FIG. 2, pressure data collected by pressure sensor 68 are presented under test conditions where orifices of increasingly smaller diameter were placed in location 72. At the point of lowest restriction shown in FIG. 2, the difference in the gas pressures ($P_{diff}$) sensed by sensor 68 when EGR valve 64 is in the normal open versus the closed position is low. As progressively smaller orifices are placed in line 70 so as to simulate gradual blockage of the line, the difference in the EGR valve normal open and closed pressures gradually rises. As the degree of blockage continues to increase (simulated by successively smaller orifices in the system for the purposes of this test), the difference in the two pressures, $P_{diff}$, begins to rise precipitously and exceeds a threshold, identified as Threshold 2 in FIG. 2. If the blockage occurs gradually, comparing the difference of the pressure to Threshold 2 will detect blockage problems. However, at the highest restriction portion of FIG. 2, i.e., the most highly blocked condition, the difference in pressure drops below Threshold 2. Thus, it is indistinguishable from a low blockage case (left portion of FIG. 2). This situation occurs in the case that the degree of blockage markedly increases from an acceptable level to an almost fully blocked situation within the time that elapses between successive iterations of the EGR valve diagnostic procedure.

FIG. 2 further illustrates that the pressure sensed by pressure sensor 68 during the EGR valve on portion of the diagnostic procedure, $P_{on}$, rises when the restriction is high. Thus according to the present invention, a false EGR system "pass" is avoided by comparing the sensed pressure, $P_{on}$, with Threshold 3, a third threshold value applicable only when the valve is open. This comparison proceeds as described below.

Figure 3:
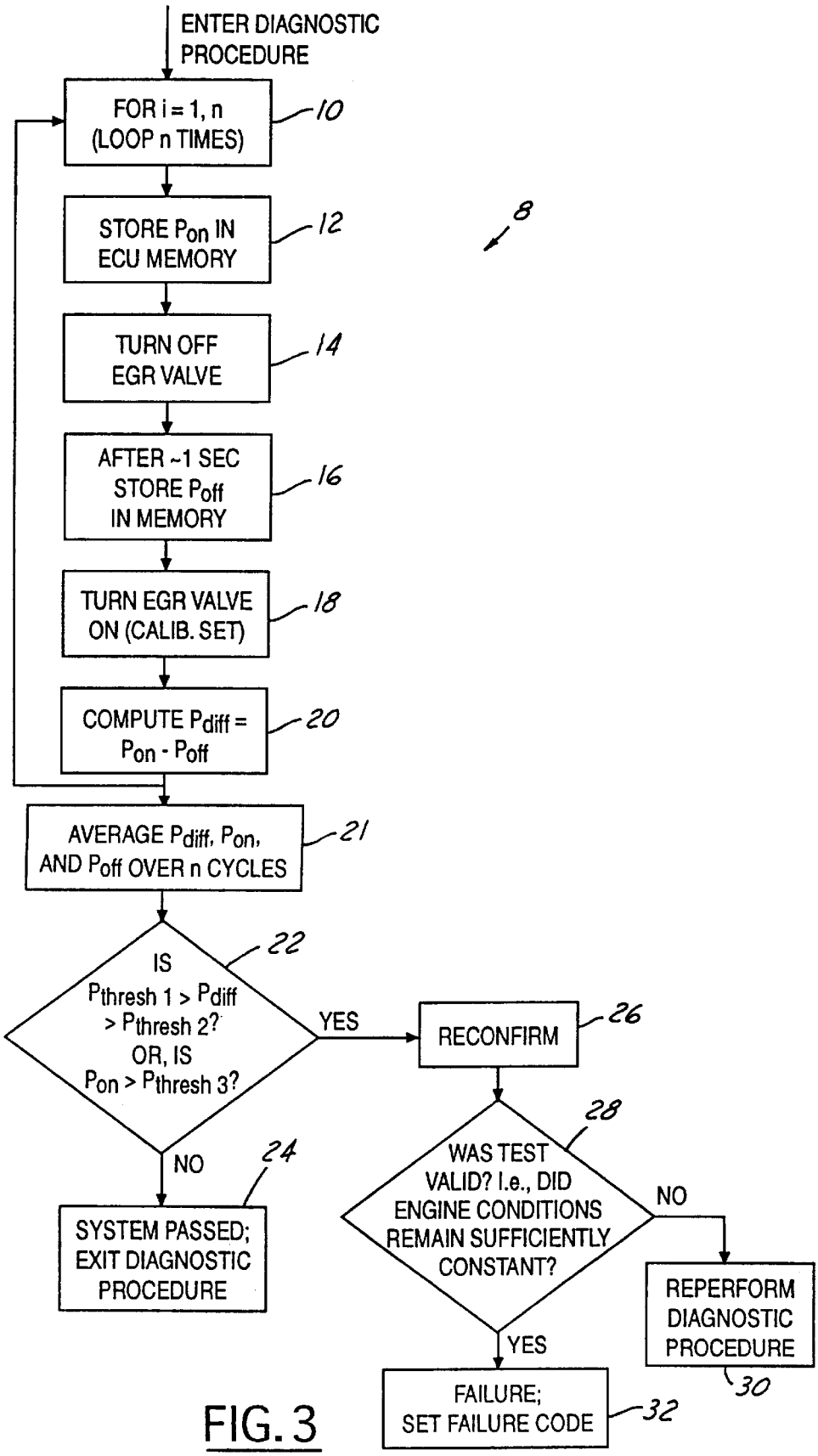
FIG. 3 is a flowchart illustrating operation of an engine according to the present invention.

FIG. 3 shows a flowchart of the operation of a diagnostic procedure according to the present invention. Engine controller 78 determines when to enter the EGR valve diagnostic procedure 8. In this regard, engine controller 78 selects an engine operating condition in which the EGR valve is at least partially open. For improved confidence in EGR valve 64 diagnostic procedure 8, the data are collected a number of times and averaged. The looping is set up in block 10 such that blocks 12 through 20 are performed n times. At block 12, the pressure at the downstream side of EGR valve 64 is stored in memory of controller 78 as $P_{on}$. Next EGR valve 64 is closed at block 14. At some predetermined time after the valve is closed and the pressure signal has stabilized, the pressure at the downstream side of EGR valve 64 is stored in memory at block 16 as $P_{off}$. Then, at block 18, EGR valve 64 is returned to its normal operation position. At block 20, $P_{diff}$ is computed as $P_{on}$-$P_{off}$. Blocks 12 through 20 are repeated n times and the n values of $P_{on}$, $P_{off}$, and $P_{diff}$ are averaged in block 21. Next, in block 22, $P_{diff}$ is compared to $P_{thresh2}$ and $P_{off}$ is compared to $P_{thres3}$. If either $P_{thresh1}>P_{diff}>P_{thresh2}$ or $P_{off}>P_{thres3}$, a failure is identified and the failure must be reconfirmed in block 26. If not, the system has passed, in block 24, and the diagnostic procedure is repeated as determined by the engine controller 78. If a failure is identified, the test is validated at block 28 to determine that the engine conditions were sufficiently stable during the EGR valve diagnostic procedure. If answer at block 28 is "no" (invalid), the diagnostic procedure is reperformed at block 30. If answer at block 28 is "yes" (valid), a failure code is set in the engine controller 78 and appropriate fault light 80 is illuminated in the passenger compartment.

While the invention has been shown and described in its preferred embodiments, it will be clear to those skilled in the arts to which it pertains that many changes and modifications may be made thereto without departing from the scope of the invention.

What is claimed is:

1. A method of monitoring the integrity of an EGR system of an automotive engine, having an EGR valve and an EGR line for conducting exhaust gas to and from said EGR valve, comprising the steps of:

measuring gas pressure in said EGR line at said location downstream of the EGR valve, with the EGR valve being in an open position;

measuring a gas pressure in an EGR duct at a location downstream of an EGR valve, with the EGR valve being in a closed position;

determining the gas pressure difference between the gas pressure measured with the EGR valve open and the gas pressure measured with the EGR valve closed; and in the event that the gas pressure difference is either less than a first threshold value or greater than a second threshold value, or in the further event that the gas pressure measured with the EGR valve closed is greater than a third threshold value, setting a flag indicating that operation of the EGR system is impaired.

2. A method according to claim 1, wherein the gas pressure within the EGR line is measured periodically during normal operation of a vehicle.

3. A method according to claim 1, wherein the values of said thresholds are adjusted according to measured values of one or more engine operating parameters.

4. A method according to claim 1, wherein if impaired operation of the EGR system is detected, the measurement is repeated to confirm failure.

5. A method according to claim 1, wherein if impaired operation of the EGR system is detected, a validity check is performed to determine if the engine operation is sufficiently stable throughout the measurement duration.

6. A method according to claim 1, wherein said third threshold is computed as barometric pressure less a constant.

7. A method according to claim 1, wherein the number of loops over which said measured gas pressure value with the EGR valve open, said measured gas pressure value with the EGR valve closed, and value of said gas pressure difference are collected and averaged is between 5 and 20.

8. A system for monitoring the integrity of an EGR system of an automotive engine, comprising:

an EGR line and valve assembly including an EGR valve, an upstream EGR line extending between an exhaust pipe and the EGR valve, and a downstream EGR line extending between the EGR valve and an intake system operatively associated with the engine;

an engine controller for receiving inputs from a plurality of engine sensors and for operating at least the EGR valve;

a gas pressure sensor mounted within the downstream EGR line for producing a signal having a value related to the gas pressure within the downstream EGR line with said gas pressure sensor being connected with said engine controller;

a processor located within said controller for alternately opening and closing said EGR valve and for storing said values of gas pressure within the downstream EGR line during said EGR valve opening and said EGR valve closing;

computing the difference in said gas pressures; and determining that the EGR system is impaired either in the event that the difference between the gas pressures is less than the first threshold value or the difference between the gas pressures is greater than the second threshold value, or in the further event that the gas pressure with the EGR valve open exceeds the third threshold value.

* * * * *